United States Patent [19]

Hazelton

[11] Patent Number: 4,892,579

[45] Date of Patent: Jan. 9, 1990

[54] PROCESS FOR PREPARING AN AMORPHOUS ALLOY BODY FROM MIXED CRYSTALLINE ELEMENTAL METAL POWDERS

[75] Inventor: Lowell E. Hazelton, Sunol, Calif.

[73] Assignee: The Dow Chemical Company, Midland, Mich.

[21] Appl. No.: 285,677

[22] Filed: Dec. 16, 1988

Related U.S. Application Data

[63] Continuation of Ser. No. 184,533, Apr. 21, 1988, abandoned.

[51] Int. Cl.[4] ..... B22F 9/00

[52] U.S. Cl. ..... 75/0.5 B; 75/0.5 BA; 75/0.5 BB; 75/0.5 BC

[58] Field of Search ..... 75/0.5 B, 0.5 BA, 0.5 BB, 75/0.5 BC; 419/2, 45

[56] References Cited

U.S. PATENT DOCUMENTS

| | | | |
|---|---|---|---|
| 706,475 | 8/1902 | Pohl | 75/0.5 B |
| 1,513,280 | 10/1924 | Schmidt | 75/88 |
| 1,670,049 | 5/1928 | Schertel et al. | 75/0.5 B |
| 1,687,034 | 10/1928 | Newell | 75/0.5 B |
| 2,037,672 | 4/1986 | Zeiss | 75/0.5 B |
| 2,451,546 | 10/1948 | Forton | 75/0.5 B |
| 3,009,205 | 11/1961 | Monson et al. | 18/47.3 |
| 3,042,511 | 7/1962 | Reding, Jr. | 75/0.5 B |
| 3,049,421 | 8/1962 | Allen et al. | 75/0.5 R |
| 3,151,971 | 10/1964 | Clough | 75/0.5 B |
| 3,647,524 | 3/1972 | Lindblon | 75/0.5 B |
| 4,484,943 | 11/1984 | Miura et al. | 75/0.5 B |
| 4,533,382 | 8/1985 | Miura et al. | 75/0.5 C |
| 4,564,396 | 1/1986 | Johnson et al. | 148/403 |
| 4,617,055 | 10/1986 | Miura et al. | 75/251 |
| 4,629,931 | 12/1986 | Clark, Jr. et al. | 313/362.1 |
| 4,640,817 | 2/1987 | Kajimara et al. | 420/50 |
| 4,710,236 | 12/1987 | Schultz | 148/11.5 P |

OTHER PUBLICATIONS

S. Akavipat et al., "Electrochemical and Auger Measurements on Boron Implanted Magnesium," J. Proc. Electrochem. Soc. 84-3, pp. 52-61.

M. Atzmon et al., "Formation and Growth of Amorphous Phases by Solid-State Reaction in Elemental Composites Compared by Cold Working," J. Appl. Phys. Lett. 45 (10), (Nov. 15, 1984), pp. 1052-1053.

J. D. Ayers et al., "Very Fine Metal Powders," J. Metals (Aug. 1985), pp. 16-21.

B. M. Clemens, "Amorphous Zirconium-Nickel Films Formed by Solid State Reactions," J. Non-Cryst Solids 61 & 62 (1984), pp. 817-822.

H. Hahn et al., "Diffusion and Solid State Reactions in Nanophase Materials," research disclosure of Materials Science Division, The Argonne National Laboratory, Argonne, IL 60439.

C. C. Koch et al., "Preparation of 'Amorphous' Ni60Nb40 by Mechanical Alloying," J. Appl. Phys. Lett. 43 (11), (Dec. 1, 1983), pp. 1017-10.

L. Schultz, "Preparation of Thick Amorphous Metals by Jelly Roll Technique and Rapid Diffusion," Amorphous Metals and Non-equilibrium Processing, MRS 1984 conference procedings, M. Von Allmen, Ed. (Les Editions de Physique, Les Ulis, 1984), pp. 135-140.

R. B. Schwarz et al., "Formation of an Amorphous Alloy by Solid-State Reaction of the Pure Polycrystalline Metals," J. Phys. Rev. Lett. 51, 5, (Aug. 1, 1983), pp. 415-418.

R. B. Schwarz et al., "The Synthesis of Amorphous Ni-Ti Alloy Powders by Mechanical Alloying," J. Non-Cryst. Solids 76 (1985), pp. 281-302.

Sommer et al., "Thermodynamic Investigations of Mg-Cu and Mg-Ni Metallic Glasses," J. Physique (1980), pp. 563-566.

P. L. Hagans, "Electrochemical Study of the Passivation and Passive Film Breakdown of Mg70Zn30 Metallic Glass," Mat. Res. Soc. Symp. Proc., vol. 80 (1987), pp. 113-120.

W. J. Meng et al., "Maximum Thickness of Amorphous NiZr Interlayers Formed by a Solid-State Reaction Technique," Appl. Phys. Lett. (21) (Nov. 23, 1987), pp. 1693-1695.

K. Samwer et al., "Formation of Amorphous ZrCo Alloys by a Solid State Reaction," Rapidly Quenched Metals, S. Steeb, H. Warlimont, eds., Elsevier Science Publishers B.V., 1985, pp. 1577-1580.

W. J. Meng et al., "Solid-State Interdiffusion Reactions in Ni/Ti and Ni/Zr multilayered Thin Films," *Appl. Phys. Lett.* 51(9), (Aug. 31, 1987), pp. 661-663.

R. B. Schwarz et al., "A Study of Amorphous Alloys of Au with Group IIIA Elements (Y and La) Formed by (List continued on next page.)

*Primary Examiner*—L. Dewayne Rutledge
*Assistant Examiner*—David Schumaker
*Attorney, Agent, or Firm*—Barbara J. Sutherland

[57] ABSTRACT

A process for preparing a substantially amorphous metal alloy body from substantially crystalline mixed elemental metal powders is disclosed. The process for producing the mixed elemental metal powders comprises the step of (1) entraining vapors of at least a first metal and a second metal, the two metals having a negative heat of mixing when combined, in separate heated inert gas streams; (2) cooling each inert gas stream adiabatically by passing it through a nozzle, to produce elemental metal powder aerosols; (3) mixing the inert gas streams to produce mixed elemental metal powder aerosols; and (4) collecting the mixed elemental metal powder aerosols to form mixed elemental powders. The powders can then be compacted to form a compacted body and the compacted body thermally reacted under reaction conditions sufficient to form the substantially amorphous metal alloy body. The processes to make the powders and the substantially amorphous metal alloy body can be done using elemental and/or appropriately selected combined-state metals as starting materials.

30 Claims, No Drawings

OTHER PUBLICATIONS a Solid-State Diffusion Reaction," J. Non-Crystal, Solids 61 & 62 (1984), pp. 129-134.

M. Van Rossum et al., "Amorphization of Hf-Ni Films by Solid-State Reaction," Phys. Rev. B., 20(10), May 15, 1984, pp. 5498-5503.

Johnson et al., "Metallic Glass Formation by Solid State Diffusion Reactions-Relationship to Rapid Quenching," Rapidly Quenched Metals, Steeb, Warlimont, eds., Elsevier Sci. Publ. B.V., 1985, pp. 1515-1519.

Atzmon, "Study of Amorphous Phases Formed by Solid-State Reaction in Elemental Composites," Rapidly Quenched Metals, S. Steeb, H. Warlimont, eds., Elsevier Science Publishers B.V., 1985, pp. 1561-1564.

H. Schroeder et al., "Micromechanism for Metallic--Glass Formation by Solid-State Reactions," Phys. Rev. Lett. 54(3), (Jan. 21, 1985), pp. 197-200.

R. W. Cahn et al., "Review: The Nucleation of Disorder," J. Mater. Res. 1(5), Sep./Oct. 1986, pp. 724-732.

B. M. Clemens, "Effect of Sputtering Pressure on the Structure and Solid-State Reaction of Titanium-Nickel Compositionally Modulated film," J. Appl. Phys. 61(9), May 1, 1987, pp. 4525-4529.

E. J. Cotts et al., "Calirometric Study of Amorphization in Planar Binary, Multilayer, Thin-Film Diffusion Couples of Ni and Zr," Phys. Rev. Lett. 57(18), Nov. 3, 1986, pp. 2295-2298.

M. Van Rossum et al., "Amorphization of Thin Multilayer Films by Ion Mixing and Solid State Reaction," Mat. Res. Soc. Symp. Proc., vol. 27 (1984), pp. 127-132.

J. J. Hauser, "Crucial Role of Residual Gases in Amorphization of Crystalline Films," Phys. Rev. B, 32(5), Sep. 1, 1985.

B. M. Clemens et al., "Amorphous Phase Formation in Solid State Reactions of Layered Nickel Zirconium Films," Research publication GMR-4986.

J. C. Barbour, "Diffusivity of Ni in an Amorphous Ni-Zr Alloy," Phys. Rev. Lett. 55(26), Dec. 23, 1985.

B. M. Clemens et al., "Amorphous Iron-Zirconcium Formed by Solid State Reaction," Research Publication GMR-5057, General Motors Research Laboratories, Warren MI 48090, May, 1985.

PROCESS FOR PREPARING AN AMORPHOUS ALLOY BODY FROM MIXED CRYSTALLINE ELEMENTAL METAL POWDERS

CROSS-REFERENCE TO RELATED APPLICATION

This is a continuation of application Ser. No. 184,533 filed Apr. 21, 1988 now abandoned.

BACKGROUND OF THE INVENTION

The present invention relates to the field of powder metallurgy. More specifically, it relates to the field of preparing amorphous alloys from mixed crystalline elemental metal powders.

In the field of metal alloys it is generally known that amorphous alloys exhibit improvements in various properties when compared with crystalline alloys. These properties include tensile strength, hardness, ductility, corrosion resistance, magnetic properties including hysteresis loss and magnetoelastic effects, and so forth. It is also known that the rate at which an alloy is cooled can be important in determining whether the alloy is amorphous and hence what properties it will have. In general faster cooling can be used to produce amorphous alloys. Specifically, cooling rates on the order of about $10^6$ K/s or faster are needed for the preparation of many amorphous alloys. Toward this end various methods have been developed to cool, or "quench," the alloy materials quickly.

One of the most commonly used of the rapid cooling methods is melt-spinning. This is a form of liquid quenching that involves contacting the liquid alloy material with the surface of a thermally conductive material, e.g., a copper surface. This is generally done by laying a liquid coating onto a rapidly spinning wheel. The liquid alloy material cools as it contacts the conductive surface, and the spinning action causes it to form a continuous thin ribbon of solid alloy.

Other methods of liquid cooling include splat quenching, which results in small thin alloy foils, and laser surface modification, such as is disclosed in U.S. Pat. No. 4,613,386, which method is suitable for surface alloying. Other quenching methods include quenching liquid droplets into gas, into liquid, or onto a cool surface, or flame-spraying liquid droplets onto a cool surface. However, all of these quenching methods are generally unsuitable to producing thick amorphous alloy bodies. This is because nucleation and substantial growth of crystalline compounds generally occur due to retardation of the cooling rate, if a thick liquid layer or droplet is being quenched. Thus, the desirable amorphous properties are lost.

Another general method is vapor quenching, which can be performed when a surface alloy coating is desired, such as for the application of corrosion resistant coatings. This type of quenching can be done, for example, by evaporation, a method which tends to result in a fairly poor bond between the coating and the substrate. It requires a relatively long time period and the use of a high vacuum system. A second type of vapor quenching is sputtering. Sputter deposition involves contacting a cold substrate with a plasma containing the desired metal ions. The high energies of the metal ions are used to facilitate the mixing of some of the plasma atoms with the surface atoms. The result is better bonding than that attainable by the evaporation method, but since the procedure must be carried out using an inert gas plasma, a portion of the inert gas is also incorporated in the alloy. Ion implantation techniques can also be used to produce amorphous alloys. For this a high energy ion beam is focused on a crystalline metal surface. The ions penetrate the surface and leave amorphous alloy in their paths.

The above methods are all potentially suited to producing alloys which are amorphous, under the right conditions. These amorphous alloys will in many cases show the improved strength, corrosion resistance, and magnetic properties desired. However, a problem encountered with all of the above described methods is that the alloy being produced, whether as a coating, a ribbon, a foil, or a particle, must be extremely thin. For example, in the case of liquid quenching, the alloy body must generally be less than about 100 microns in thickness in order to enable the cooling rate necessary to ensure an amorphous product. In the case of ion implantation the use of commercially reasonable ion energies results in a thin amorphous layer, i.e., on the order of no more than a few microns, to enable penetration with reasonable ion energies. In the case of evaporation methods the alloy body must be thin to prevent peeling due to inadequate substrate adhesion. Finally, in the case of both evaporation and sputtering the alloy bodies are generally thin because of the extensive time required to build up thicker alloy bodies. Crystallization generally results during processes to compact these ribbons or particles under heat and pressure sufficient to form a monolithic, bulk piece of metal exhibiting bonds between the ribbons or particles whose strength is equivalent to that of the material itself.

An exception to this is disclosed in W. L. Johnson et al., *Phys. Rev. Lett.* 51 (1983) 415. That publication demonstrates that thin, alternating layers of certain polycrystalline pure metals formed by evaporation or sputtering can be thermally reacted to form an amorphous alloy at temperatures below the selected metals' crystallization temperatures. The alloys formed by this method appear to share two common characteristics: (1) they are formed of metal combinations having a large negative heat of mixing; and (2) the diffusion takes place primarily in one direction, with one metal having very rapid diffusion in the other metal. Again, however, only thin films can be produced, and it is not possible to form complex bulk shapes thereby.

Thus, only alloys produced from powders appear to be suitable for forming bulk shapes. One method of doing this is to ball-mill commercially available coarser elemental metal powders together to mix them, and then to compact and, in some cases, to heat them, at a temperature below the crystallization point, in the desired shape to alloy them. This results in a substantially amorphous alloy body. However, ball-milling has two primary drawbacks: (1) It tends to incorporate significant quantities of impurities into the metal powders; and (2) it is relatively expensive and time-consuming.

In view of the above, there is a need for a method of producing substantially amorphous alloy bodies which are not subject to thickness limitations, do not incorporate significant quantities of impurities, can be densified to theoretical or near-theoretical density in complex bulk shapes, are of substantially uniform composition, and maintain the desirable properties inherent in being amorphous, as discussed above.

SUMMARY OF THE INVENTION

Accordingly, the present invention provides a process for preparing a substantially amorphous metal alloy body of any desired thickness, using mixed elemental metal powders as a starting material. The powders can be prepared by a process comprising the steps of: (1) entraining vapors of at least a first metal and a second metal, the two metals being selected such that they have a negative heat of mixing when combined, in separate heated inert gas streams; (2) cooling each inert gas stream adiabatically by passing it through a nozzle, to produce an elemental metal powder aerosol; (3) mixing the inert gas streams to produce mixed elemental metal powder aerosols; and (4) collecting the mixed elemental metal powder aerosols to form mixed elemental metal powders. The powders can be compacted to form a compacted body, and the compacted body then thermally reacted under reaction conditions sufficient to form a substantially amorphous metal alloy body. The powders can be formed using elemental starting materials, combined-state metal starting materials, or a combination thereof.

The present invention further provides a method of preparing the mixed elemental metal powders specifically from combined-state metals. These powders can be prepared by a process comprising the steps of: (1) selecting at least a first compound and a second compound, each compound comprising a metal and a non-metal constituent and having a decomposition temperature below the boiling point of the respective metal, the compound being gaseous at its decomposition temperature, the decomposition temperature of the compound being above the boiling point of the non-metal constituent, the compounds being selected such that their metals have a negative heat of mixing when combined; (2) entraining each compound in a separate heated inert gas stream such that the compound is heated to at least its decomposition temperature to form a metal vapor; (3) cooling each inert gas stream adiabatically, by passing it through a nozzle, sufficiently to form an elemental metal powder aerosol without condensing the non-metal constituent; (4) mixing the inert gas streams to produce mixed elemental metal powder aerosols; and (5) collecting the mixed elemental metal powder aerosols to form mixed elemental metal powders.

DESCRIPTION OF ILLUSTRATIVE EMBODIMENTS

In general, the present invention, in one embodiment, is a process for preparing a substantially amorphous metal alloy body of any desired thickness by a solid state reaction of mixed elemental metal powders. In another embodiment it is a generalized method of preparing the mixed elemental metal powders themselves. These powders can be prepared using elemental metals, combined-state metals, or at least one elemental metal and at least one combined-state metal as starting materials. In another embodiment it is a process for preparing the mixed elemental metal powders specifically from combined-state metals as starting materials.

In the method of the present invention the metals to be alloyed are preferably selected using two main criteria: (1) They have a negative free energy of mixing, the more negative the better; and (2) each selected metal has an acceptable rate of diffusion into the other selected metal or metals at a given temperature, the faster the better. Both of these features operate to promote the diffusion process necessary to produce the alloy.

In order to enable the desired diffusion rates, the metals are also preferably selected such that at least one metal from Group IIIB, IVB and/or VB and at least one metal from Group VIII and/or IB of the Periodic Table are used. For reference purposes the metals from Group IIIB, IVB and VB will be designated as the "first metal," and the metals from Group VIII and IB will be designated as the "second metal." Metals from other groups will be designated simply as "other metals" and serve as a reference by which to compare diffusion rates. The elements of Groups IIIB, IVB and VB can generally be designated, respectively, as the scandium, titanium and vanadium groups, including the lanthanum and actinium series. Groups IIIB and IVB include scandium, yttrium, lanthanum, actinium, titanium, zirconium, rutherfordium, hafnium, vanadium, niobium, tantalum, hafnium, and the lanthanides and actinides. The lanthanides and actinides include cerium, praseodymium, neodymium, promethium, samarium, europium, gadolinium, terbium, dysprosium, holmium, erbium, thulium, ytterbium, lutetium, thorium, protactinium, uranium, neptunium, plutonium, americium, curium, berkelium, californium, einsteinium, fermium, mendelevium, nobelium, and lawrencium. Groups VIII and IB include iron, ruthenium, osmium, cobalt, rhodium, iridium, nickel, palladium, platinum, copper, silver and gold.

The above combinations of early transition and later transition metals produce good alloy results. For example, nickel can be effectively alloyed with titanium, zirconium, hafnium, niobium, or any of the rare earth metals such as erbium, because these combinations of metals have a negative free energy of mixing ranging from about −45 kJ/mol to about −70 kJ/mol. Similarly, cobalt alloys well with zirconium; gold with lanthanum or yttrium; and copper with erbium or zirconium. Other combinations are also possible and within the purview of the present invention. There is also preferably at least about an order of magnitude difference between the diffusion rate of the second metal into the first metal and the diffusion rate of the "other metals" group into the first metal.

In one embodiment of the present invention one or both of the metals are initially in their elemental state. In another embodiment of the present invention one or both of the metals are initially in a combined state, preferably with a non-metal constituent. When a metal in a combined state is to be used, the compound is preferably selected such that it has a decomposition temperature below the boiling point of the respective metal. In this case the decomposition temperature of the metal is preferably above the boiling point of the non-metal constituent. As noted above, it is desirable that the compounds are selected such that their metals have a negative heat of mixing when combined. Salts and organometallic compounds are preferred.

In general, once the metals are selected they are vaporized. This vaporization can be done by any method of heating, e.g., using furnace methods, radio frequency induction heating, microwave heating, electron beam heating, laser heating, etc., and results in formation of the vapor of the metal. The vaporization is done under a heated inert atmosphere. Argon and helium are preferred for this, with argon being more preferred for reasons of economy; however, any gas inert to the selected metals can be used. For example, neon and the heavier gases, such as krypton, xenon, and radon can also be used. The inert atmosphere serves to prevent oxidation of the metals, which are pyrophoric in finely divided form.

However, the temperature at which vaporization is effected is determined by the identity of the metal as well as whether it is in a combined or elemental state. If elemental it is preferable to use an inert gas at a temperature at or above the metal+s boiling point in order to maintain the metal in its vapor state. The boiling point is herein defined as the temperature at which the metal vaporizes, and thus will vary depending on the pressure under which the process is conducted. Preferably a pressure from about 1 to about 10 torr is used. Similarly, if in the combined state, the metal-containing compound is preferably entrained at an inert gas temperature above the compound's decomposition temperature. In this embodiment of the present invention the compound should thus preferably be selected such that the boiling temperature of the metal is above the compound's decomposition temperature, which, in turn, is above the boiling point of the remaining species, and more preferably above by at least 10° C. It is further preferred that the boiling point of the remaining species is below room temperature. Thus, in either case elemental metal can be isolated during the subsequent condensation step.

Following vaporization of the metal, the elemental metal vapor is condensed. In one preferred embodiment the inert gases separately entraining the metal vapors are rapidly cooled, thereby condensing the vapors to form particles. This cooling can preferably be done adiabatically, for example, by passing each gas stream individually through a nozzle to expand it. Thus, a convergent-divergent nozzle can preferably be used. In the case of using a metal-containing compound to start, the cooling is preferably done to a temperature that is low enough to condense most of the vapor but which is still above the boiling point of the non-metal constituent. Thus, the non-metal constituent is not condensed and is thereby separated. In the case of elemental starting metals, the cooling is preferably done to any temperature low enough to condense most of the vapor. These particles form aerosols in their respective carrier gases. It is preferable that the resultant powder particles be substantially fine in size, i.e., less than about 1 micron in diameter, more preferable that they be less than about 0.5 micron in diameter, and most preferable that they be less than about 0.2 micron in diameter. The small size offers an important advantage: The increased surface area expedites diffusion during later thermal reaction and allows a reduction in the temperature and compaction pressure needed to reach theoretical density during the compaction step.

Following the condensation of the metal vapors to form fine metal particles entrained as aerosols in separate inert gas streams, the gas streams are mixed together. This mixing of the gas streams results in a high degree of mixing of the metal particles.

The resultant mixed elemental metal particles are next collected. Various methods of collection can be used, such as electrostatic precipitation, thermophoresis, sonic agglomeration followed by cyclonic precipitation, and so forth. Of these, electrostatic precipitation and sonic agglomeration followed by cyclonic precipitation are preferred. The collected particles form mixed elemental metal powders.

The mixed elemental metal powders prepared by the above-described processes are generally submicron in size, substantially crystalline in form, and show a very uniform size distribution. Because of their fine size and resultant increased surface area, they can be more easily compacted to form a dense body. As noted above, this dense, compacted body can be of any desired size, shape and thickness. The compaction temperature and pressure will vary according to the metals being alloyed, as determined by methods known to those skilled in the art, but in general can be reduced relative to the temperature and pressure required for the coarser powders commonly used in powder metallurgy. In any event it is important that the compaction temperature and pressure not be sufficient to result in significant crystallization, since the advantages of amorphous alloys would be thereby compromised. Conventionally used compaction procedures and equipment, such as, for example, die and isostatic pressing means, can be employed. In order to produce a commercially desirable product compaction is preferably done to a point from about 75 percent to about 100 percent of theoretical density, preferably about 90 percent to about 100 percent, and most preferably at least about 98 percent. The high density imparts maximum strength properties.

Following compaction by any conventional method the compacted body is thermally reacted to form a substantially amorphous metal alloy body. It is very important that this thermal reaction be carried out at a temperature below the crystallization point for the amorphous alloy, since higher temperatures result in nucleation and substantial crystallization. However, the reaction is also preferably done at a temperature, time and pressure sufficient to allow for maximum diffusion and amorphous alloy formation. One skilled in the art can determine these variables according to the metals being alloyed, taking into account that too high a temperature and/or too long a time results in stable or metastable crystalline phase formation, while the converse results in an incomplete or unacceptably slow reaction. The thermal reaction can be done using conventional equipment. For example, furnace means can be employed, preferably at a temperature from about 80° C. to about 350° C. In this temperature range all of the metal combinations specifically mentioned herein form at least partially amorphous alloys, and most form substantially amorphous alloys. As defined herein, substantially amorphous bodies are at least about 80 percent amorphous, preferably at least about 90 percent amorphous, and most preferably 100 percent amorphous, as determined by X-ray diffraction analysis.

The following examples are given to more clearly show the present invention. They are intended to be, and should be construed as being, illustrative only are not limitative of the scope of the invention. All parts and percentages are by weight unless otherwise indicated.

EXAMPLE 1

About 20 g of nickel is loaded into an evaporation vessel. A convergent-divergent nozzle is attached to the lower end of the vessel. This vessel is then assembled into a furnace, denoted "furnace #1", and inlet and outlet gas tubing connections are made. At the same time about 57 g of erbium is loaded into a second furnace, denoted "furnace #2", which is similar in design to furnace #1. The temperature of furnace #1 is quickly raised to about 3150° C., and the temperature in furnace

#2 is quickly raised to about 1775° C. A flow of argon gas to each furnace, at a pressure of about 20 torr, entrains each metal vapor and carries it down through the nozzle. The adiabatic expansion lowers the pressure to about 2 torr and cools the mixture of metal vapor and inert gas to about 650°-750° C. in furnace #1, and to about 500°-600° C. in furnace #2. This results in complete condensation of the metal vapors into powder aerosols having an average diameter of about 120 Angstroms for both the nickel and erbium.

The tubes carrying the powders from each furnace pass into the top of an argon-filled glove box where they each connect into a single device for efficiently mixing the two aerosol streams. This mixed aerosol is then carried by a short tube to an electrostatic precipitator where the particles are collected as mixed elemental metal powders onto charged flat plates. The argon gas passes out of the precipitator and out of the glove box to a vacuum pump capable of pumping gas at a rate of 1000 liters/min. The pressure at the pump inlet is about 1 torr. The metal vaporization and condensation process is complete after about 10 minutes, after which the electrostatic precipitator is opened and the collected powder is scraped off the collection plates.

The collected powder is then placed into a 13 mm diameter pellet die and compressed, using a 25-ton press mounted inside the glove box, to a density in the range of 90–98 percent of theoretical density. Then the compacted pellet is removed and heated in a furnace located in the glove box to a temperature of about 120° C. for about 6 hours to amorphize it. X-ray diffraction results on a specimen taken from the reacted pellet show it to be almost completely amorphous.

EXAMPLE 2

About 20 g of copper and about 52 g of erbium are used in the same process as in Example 1 in place of that Example's nickel and erbium, respectively. The copper is heated to about 1850° C., while the erbium is processed as before. After adiabatic expansion the copper is cooled to about 525°-625° C. The final amorphization reaction is done at 90° C. for about 5 hours as described in Example 1.

EXAMPLE 3

About 20 g of nickel and about 16.3 g of titanium are used in the same process as in Example 1 in place of that Example's nickel and erbium, respectively. The nickel is heated as in that example, while the titanium is heated to about 2475° C., then cooled to about 775°-875° C. by adiabatic expansion. The final amorphization reaction is done at 275° C. for about 10 hours. The result is partially amorphous.

I claim:

1. A process for preparing mixed elemental metal powders comprising the steps of:

(1) entraining vapors of at least a first metal and a second metal, the two metals being selected such that they have a negative heat of mixing when combined, in separate heated inert gas streams;

(2) cooling each inert gas stream adiabatically by passing it through a nozzle, to produce an elemental metal powder aerosol;

(3) mixing the inert gas streams to produce mixed elemental metal powder aerosols;

(4) collecting the mixed elemental metal powder aerosols to form mixed elemental metal powders.

2. The process of claim 1 wherein the first metal is selected from the group consisting of scandium, yttrium, lanthanum, actinium, cerium, praseodymium, neodymium, promethium, samarium, europium, gadolinium, terbium, dysprosium, holmium, erbium, thulium, ytterbium, lutetium, thorium, protactinium, uranium, neptunium, plutonium, americium, curium, berkelium, californium, einsteinium, fermium, mendelevium, nobelium, lawrencium, titanium, zirconium, rutherfordium, hafnium, vanadium, niobium, hahnium and tantalum, and the second metal is selected from the group consisting of iron, ruthenium, osmium, cobalt, rhodium, iridium, nickel, palladium, platinum, copper, gold, and silver.

3. The process of claim 2 wherein the second metal has a rate of diffusion in the first metal at least one order of magnitude greater than the rate of diffusion of other metals in the first metal at a given temperature.

4. The process of claim 3 wherein the first metal is selected from the group consisting of titanium, zirconium, hafnium, niobium, and erbium, and the second metal is nickel.

5. The process of claim 3 wherein the first and second metals are zirconium and cobalt, respectively.

6. The process of claim 3 wherein the first metal is selected from the group consisting of lanthanum and yttrium, and the second metal is gold.

7. The process of claim 3 wherein the first metal is selected from the group consisting of erbium and zirconium, and the second metal is copper.

8. The process of claim 1 wherein the inert gas is selected from the group consisting of argon, helium, neon, xenon, radon, and krypton.

9. The process of claim 1 wherein the collection is done by means of electrostatic precipitation. electrophoresis, or sonic agglomeration followed by cyclonic precipitation.

10. The process of claim 1 wherein the powders are substantially crystalline.

11. The process of claim 1 wherein the powders are substantially submicron in diameter.

12. The process of claim 1 further comprising the step of compacting the powders to form a compacted body.

13. The process of claim 12 wherein the compaction is done by means of die or isostatic pressing means.

14. The process of claim 12 further comprising thermally reacting the compacted body under reaction conditions sufficient to form a substantially amorphous metal alloy body.

15. The process of claim 14 wherein the thermal reaction is carried out at a temperature below the crystallization point of the alloy.

16. The process of claim 1 wherein the vapors are prepared from elemental metals, combined-state metals, or at least one elemental metal and at least one combined-state metal as starting materials.

17. A process for preparing mixed elemental metal powders from combined-state metals comprising the steps of:

(1) selecting at least a first and a second compound, each comprising a metal and a non-metal constituent and having a decomposition temperature below the boiling point of the respective metal, the compound being gaseous at its decomposition temperature, the decomposition temperature of the compound being above the boiling point of the non-metal constituent, the first and second compounds being selected such that their metals have a negative heat of mixing when combined;

(2) entraining each compound in a separate heated inert gas stream such that the compound is heated to at least its decomposition temperature to form a metal vapor;

(3) cooling each inert gas stream adiabatically, by passing it through a nozzle, sufficiently to form an elemental metal powder aerosol without condensing the non-metal constituent;

(4) mixing the inert gas streams to produce mixed elemental metal powder aerosols;

(5) collecting the mixed elemental metal powder aerosols to form mixed elemental powders.

18. The process of claim 17 wherein the first metal is selected from the group consisting of scandium, yttrium, lanthanum, actinium, cerium, praseodymium, neodymium, promethium, samarium, europium, gadolinium, terbium, dysprosium, holmium, erbium, thulium, ytterbium, lutetium, thorium, protactinium, uranium, neptunium, plutonium, americium, curium, berkelium, californium, einsteinium, fermium, mendelevium, nobelium, lawrencium, titanium, zirconium, rutherfordium, hafnium, vanadium, niobium, hahnium and tantalum, and the second metal is selected from the group consisting of iron, ruthenium, osmium, cobalt, rhodium, iridium, nickel, palladium, platinum, copper, gold, and silver.

19. The process of claim 18 wherein the second metal has a rate of diffusion in the first metal at least one order of magnitude greater than the rate of diffusion of other metals in the first metal at a given temperature.

20. The process of claim 18 wherein the first metal is selected from the group consisting of titanium, zirconium, hafnium, niobium, and erbium, the second metal is nickel.

21. The process of claim 18 wherein the first and second metals are zirconium and cobalt, respectively.

22. The process of claim 18 wherein the first metal is selected from the group consisting of lanthanum and yttrium, and the second metal is gold.

23. The process of claim 18 wherein the first metal is selected from the group consisting of erbium and zirconium, and the second metal is copper.

24. The process of claim 17 wherein the inert gas is selected from the group consisting of argon, helium, neon, xenon, radon, and krypton.

25. The process of claim 17 wherein the collecting is done by means of electrostatic precipitation, electrophoresis, or sonic agglomeration followed by cyclonic precipitation.

26. The process of claim 17 wherein the powders are substantially crystalline.

27. The process of claim 17 wherein the powders are substantially submicron in diameter.

28. The process of claim 17 further comprising the step of compacting the powders to form a compacted body.

29. The process of claim 28 further comprising the step of thermally reacting the compacted body under reaction conditions sufficient to form a substantially amorphous metal alloy body.

30. A process for preparing a substantially amorphous metal alloy body from mixed elemental metal powders comprising the steps of:

(1) entraining vapors of at least a first metal nd a second metal, the two metals being selected such that they have a negative heat of mixing when combined, in separate heated inert gas streams;

(2) cooling each inert gas stream adiabatically by passing it through a nozzle, to produce an elemental metal powder aerosol;

(3) mixing the inert gas streams to produce mixed elemental metal powder aerosols;

(4) collecting the mixed elemental metal powder aerosols to form mixed elemental metal powders;

(5) compacting the mixed elemental metal powders to form a compacted body; and (6) thermally reacting the compacted body under reaction conditions sufficient to form a substantially amorphous metal alloy body.

* * * * *

UNITED STATES PATENT AND TRADEMARK OFFICE

CERTIFICATE OF CORRECTION

PATENT NO. : 4,892,579

DATED : January 9, 1990

INVENTOR(S) : Lowell E. Hazelton

It is certified that error appears in the above-identified patent and that said Letters Patent is hereby corrected as shown below:

Cover sheet, page 2, column 2, line 4 please delete "Calirometric" and insert -- Calorimetric --.

Column 4, line 19 please delete "hafnium" and insert -- hahnium --.

Column 5, line 9 please delete "metal+s" and insert -- metal's --.

Column 10, line 25 please delete "nd" and insert -- and --.

Signed and Sealed this

Sixteenth Day of April, 1991

*Attest:*

HARRY F. MANBECK, JR.

*Attesting Officer*

*Commissioner of Patents and Trademarks*